US009415402B2

(12) United States Patent
Fenzi

(10) Patent No.: US 9,415,402 B2
(45) Date of Patent: Aug. 16, 2016

(54) METHOD AND PLANT FOR SURFACE DECORATION OF ELONGATE ITEMS

(75) Inventor: Giancario Fenzi, Illasi (IT)

(73) Assignee: COMITAL S.A.S. DI GIACOMELLO IVANA E C., Cazzano di Tramigna (VR) (IT)

( * ) Notice: Subject to any disclaimer, the term of this patent is extended or adjusted under 35 U.S.C. 154(b) by 279 days.

(21) Appl. No.: 13/819,095

(22) PCT Filed: Sep. 20, 2011

(86) PCT No.: PCT/IB2011/054124

§ 371 (c)(1),
(2), (4) Date: Mar. 13, 2013

(87) PCT Pub. No.: WO2012/038896

PCT Pub. Date: Mar. 29, 2012

(65) Prior Publication Data

US 2013/0202796 A1 Aug. 8, 2013

(30) Foreign Application Priority Data

Sep. 21, 2010 (IT) ..... VI2010A0256

(51) Int. Cl.
*B05B 1/02* (2006.01)
*B05B 13/02* (2006.01)
*B05B 15/12* (2006.01)

(52) U.S. Cl.
CPC ..... *B05B 1/02* (2013.01); *B05B 13/0207* (2013.01); *B05B 13/0278* (2013.01); *B05B 15/1207* (2013.01); *B05B 15/1292* (2013.01)

(58) Field of Classification Search
CPC .. B05B 1/02; B05B 15/1292; B05B 13/0207; B05B 15/1207; B05B 13/0278
USPC ..... 118/58, 313, 620
See application file for complete search history.

(56) References Cited

U.S. PATENT DOCUMENTS 4,390,564 A 6/1983 Kimble
4,769,650 A * 9/1988 Peng ..... B41J 2/01 347/16

FOREIGN PATENT DOCUMENTS

DE 102008029710 12/2009
EP 0080978 6/1983

* cited by examiner

*Primary Examiner* — Xiao Zhao
(74) *Attorney, Agent, or Firm* — Themis Law

(57) ABSTRACT

A plant for the surface decoration of elongate items includes an inlet section and an outlet section for one or more items having an external peripheral surface to be decorated, a support system for the elongated objects on a predetermined lying plane, a system for continuously forwarding the items from the inlet section to the outlet section along a longitudinal feeding direction, with the items substantially parallel to the same longitudinal direction, and a decorating system for the external surface of the items. The decorating system includes a plurality of jet devices arranged along the longitudinal direction, at least one of which is oriented to direct a jet of a pigmented substance on a portion of the external surface of the items at least partially different from another surface portion designed to be decorated by another device. A method for decorating elongate objects is also described.

9 Claims, 2 Drawing Sheets

METHOD AND PLANT FOR SURFACE DECORATION OF ELONGATE ITEMS

FIELD OF APPLICATION

The present invention has application in the technical field of product surface finishing by means of paints and the like. In particular, it has as object a plant for the surface decoration of elongate objects, such as sections, plates and metal sheets, made of polymer materials, metals, wood or in any case relatively rigid.

The invention also has as object a method for the surface decoration of elongated objects.

STATE OF THE ART

As is known, for the decoration of elongate objects, such as sections, metal sheets and the like, generally intended for use in the building industry, especially for the assembly of door and window fixtures and fastenings, it is possible to use different decorative materials such as inks, paints or other pigmented substances, both in liquid and powder form.

In addition, the deposition of the decorating substances can be executed according to different techniques, as a function of the base material of the object to be decorated, e.g. steel, aluminum alloy, wood and plastic material as well as the specific type of decorating material, such as sublimable paints or inks.

With reference to the latter type of decorating products, a widespread technique provides for the deposition of the same on the surface to be decorated by means of a transfer medium, generally in the form of a screen or film, on which the decorative motif to be transferred is printed; such motif is made with the sublimable paint or ink.

Nevertheless, the known decoration techniques have the recognized drawback of being excessively slow and complex, in addition to costly, due to the presence of the film.

In order to remedy such drawbacks, the same applicant has obtained a plant for decorating sections, described in the European patent application EP1867398, composed of a plurality of decoration stations sequentially arranged along the advancing line of the section.

Each decoration station has a roller for collecting pigmented substance and a deposition roller made of pliable material, e.g. rubber or silicone, adapted to transfer the pigmented substance onto a side surface of the object to be decorated.

The deposition rollers are also arranged in a manner such that, at every station, a different surface portion is decorated. This way, at the plant outlet, the surface of the object is completely decorated.

Such innovative solution, while proving widely advantageous with respect to the known solutions, has several operative limitations.

Indeed, such plant is particularly advantageous if it is necessary to decorate sections having external surface with rectangular or regular polygonal cross section.

However, if the external surface has numerous steps or undercuts, the rollers are not always able to decorate these hard-to-access zones.

Moreover, use of the rollers also limits the type of pigmented substances to be used, since it is only possible to employ liquid substances and not powders.

The presence of the rollers also requires the arrangement of a complex support structure and the removal of the excess liquid from the rollers' external surface before the deposition of such structure on the surface.

A further drawback is represented by the fact that the decoration by means of rollers generally provides for the use of so-called intaglio or relief printing techniques, whereas it is not possible to execute decorations by means of air-brush techniques.

Finally, since the decorative motif is impressed on the pigmenting substance collection roller, if one wishes to change the decorative motif it is necessary to substitute the collection rollers, with clear complications and cost increases.

Also known are plants for decorating elongated objects, i.e. those having at least one dimension predominant with respect to the others, which provide for the use of ink spray application devices.

For example, in U.S. Pat. No. 5,831,641, a plant is known for decorating three-dimensional objects which comprises an elongated decoration chamber intended to house the object to be decorated in stationary position.

Inside the chamber, an ink jet plotter is also slidably positioned, parallel to the extension direction of the chamber.

The decoration of the entire three-dimensional surface is obtained by rotating the object on itself.

Nevertheless, such plant allows decorating objects having relatively reduced length, such as baseball bats and the like, and is not suitable for being used for the decoration of objects having considerably greater length, such as sections for buildings and for fixtures.

Indeed, in such case, it is necessary to obtain a work chamber of equal length and it is also necessary to arrange suitable means for rotating the object to be decorated, with considerable cost increase.

PRESENTATION OF THE INVENTION

Object of the present invention is to overcome the drawbacks mentioned above by obtaining a plant for the surface decoration of elongate objects which is highly efficient and relatively cost-effective.

A particular object is to obtain a plant for the surface decoration of elongate items that also allows decorating surfaces with complex shape over their entire perimeter extension.

A further object is to obtain a plant for the surface decoration of elongate items which allows modifying the decorative motif to be transferred in a simple and quick manner, without having to modify the structure of the plant.

Still another object is to obtain a plant for the surface decoration of elongate items that allows controlling the quantity of pigmenting substance to be transferred, avoiding waste and not requiring the retrieval of excess substance.

Still another object of the present invention is to obtain a plant for the surface decoration of elongate items that allows decorating according to different decorative techniques, e.g. air brush techniques.

Not least object of the present invention is to obtain a plant for the surface decoration of elongate items that is structurally simple.

Such objects, as well as others which will be clearer below, are fulfilled by a plant for the surface decoration of elongate items, in accordance with claim 1, comprising an inlet section and an outlet section for one or more substantially elongate items having an external peripheral surface to be decorated, means for supporting the elongate items on a predetermined lying plane, means for continuously forwarding the items from said inlet section to said outlet section along a longitudinal feeding direction, with said items being substantially parallel to the same longitudinal direction, means for decorating the external surface of the items designed for distributing thereon at least one layer of a pigmented substance.

The plant is characterized in that the decorating means comprise a plurality of jet devices arranged along said longitudinal direction, at least one of said devices being oriented to direct a jet of pigmented substance on a portion of the external surface of the items at least partially different from another surface portion intended to be decorated by another device of said plurality.

In this manner, at the outlet section, the external side surface of the elongate item will be decorated on at least two different portions, not necessarily adjacent to each other.

Suitably, the decorating means can comprise at least one pair of said application devices arranged mutually opposite with respect to a predetermined longitudinal plane parallel to said longitudinal feeding direction in order to decorate different portions of the side surface of the elongate item.

Preferably, the decoration means can comprise a first couple of said application devices arranged mutually opposite with respect to said lying plane and a second couple of said application devices arranged mutually opposite with respect to a longitudinal center plane substantially orthogonal to said lying plane.

In addition, the devices of the first and second couple can be configured for decorating respective different portions of the side surface of the elongate item, to obtain at the outlet, in an extremely quick manner, an item decorated over its entire side surface.

Advantageous embodiments of the invention are described hereinafter.

According to a further aspect of the invention, a method is provided for the surface decoration of elongate items, implementable in a non-exclusive manner with a plant according to the invention.

BRIEF DESCRIPTION OF THE DRAWINGS

Further characteristics and advantages of the invention will be clearer in light of the detailed description of a preferred but not exclusive embodiment of a plant for the surface decoration of elongate items according to the invention, illustrated as a non-limiting example with the aid of the drawing table set, in which.

DETAILED DESCRIPTION OF A PREFERRED EMBODIMENT

With reference to the mentioned figures, a plant for decorating elongate items can be used for decorating sections, plates, metal sheets, metal plates or similar objects, in particular of the type having one dimension predominant with respect to the other two and usable for the assembly of fixtures and fastenings.

The item P to be decorated will generally have elongated form along a main extension direction X, with an external peripheral surface S that defines an axis A substantially parallel to such main extension direction X.

Figure 3:
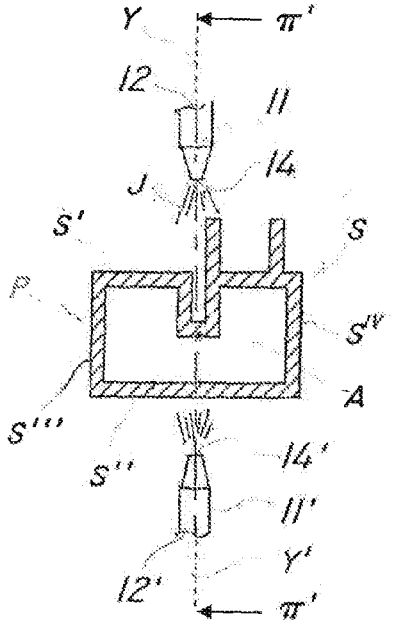
FIGS. 3 and 4 are two front views of two different details of the plant according to the invention, partially sectioned along the trace planes III-III and IV-IV of FIG. 1.
Figure 4:
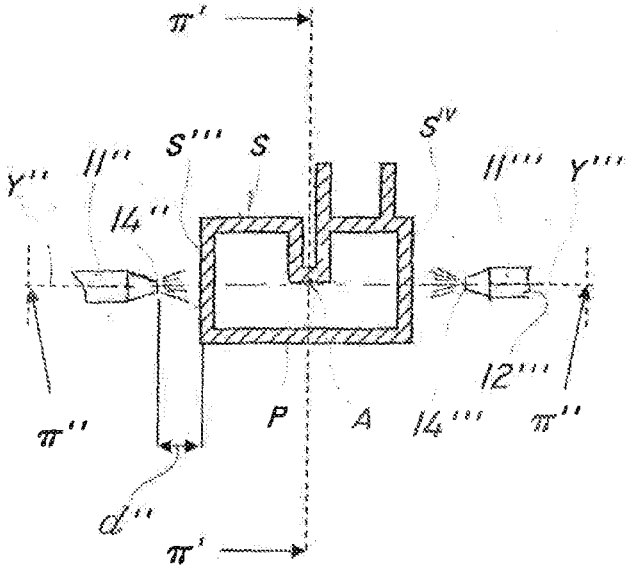

The cross section of the object P can be regular and convex or irregular, with one or more undercuts, as in the examples of FIGS. 3 and 4.

The elongate items P to be decorated can be made of any material, including metal, such as aluminum and its alloys, polymer, e.g. PVC, or it could even be made of wood.

The plant, indicated overall with the number 1, can be used for executing any one painting and/or decorating operation of the external peripheral surface S of the elongate item P, by means of application of one or more layers of a paint, ink or another pigmented substance.

The latter can be in liquid or powder form, and it can be selected from any one of the substances commonly used in the field. As a non-limiting example, it can be a liquid paint with solvent or water base, a UV ink, a sublimable ink and the like.

Figure 1:
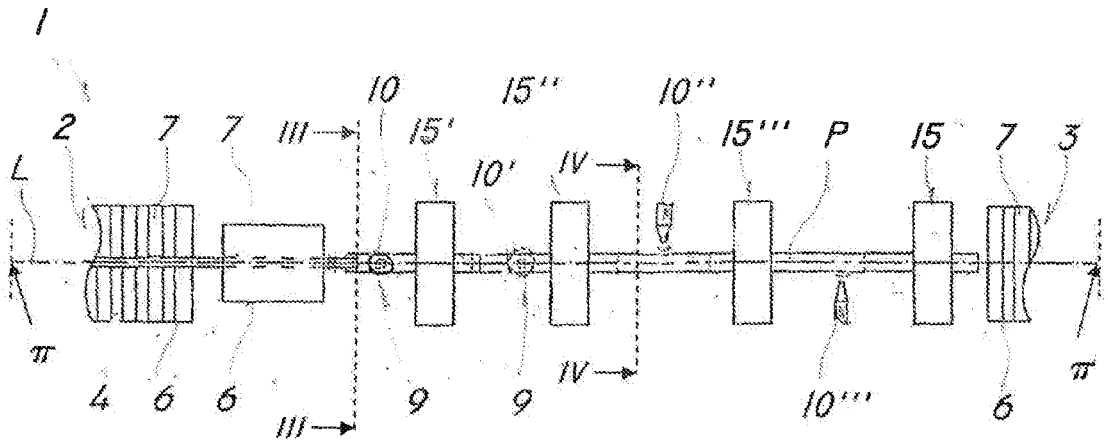
FIG. 1 is a top schematic view of a plant according to the invention.
Figure 2:
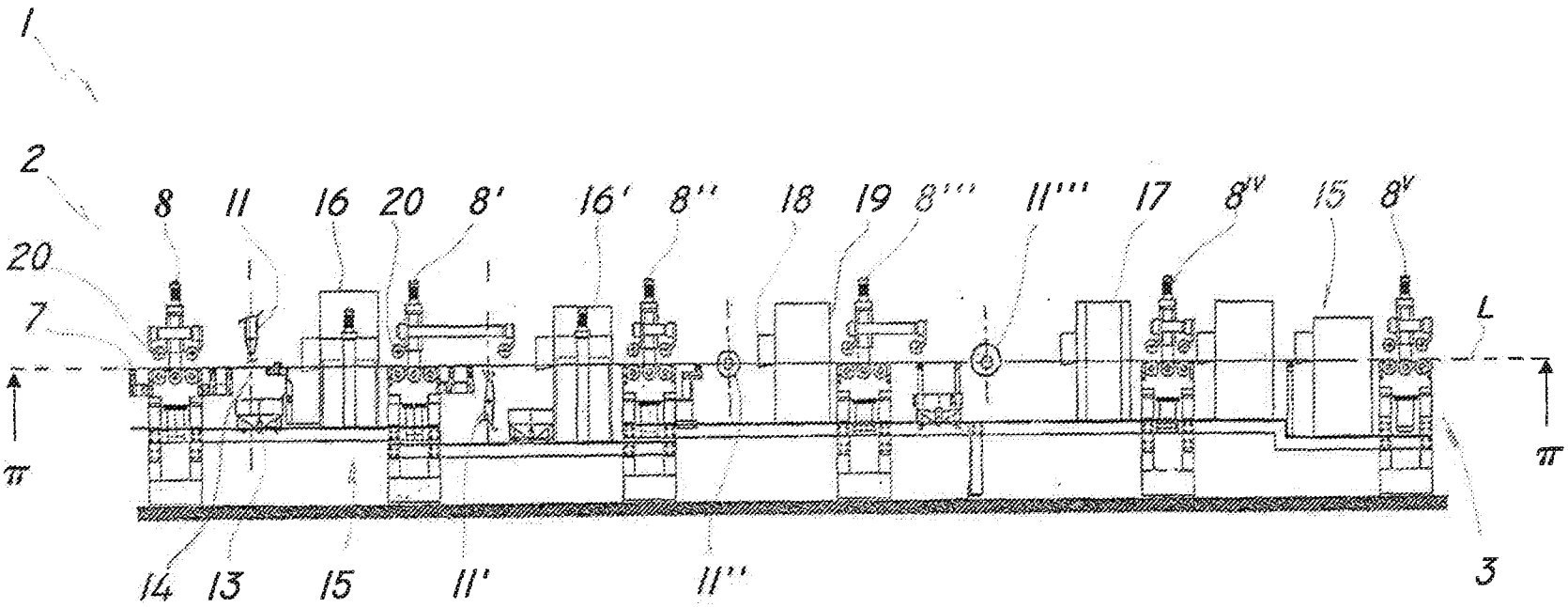
FIG. 2 is a side view of the plant according to the invention.

In its most basic configuration, the plant 1 according to the invention, visible in FIGS. 1 and 2 in a non-limiting embodiment of the invention, comprises an inlet section 2 and an outlet section 3 for an item to be decorated P, means 4 for supporting the item P in a predetermined lying plane $\pi$ and means 5 for continuously forwarding the item P from the inlet section 2 to the outlet section 3.

In particular, the forwarding means 5 are configured for moving the item P along at least one predetermined longitudinal feeding direction L parallel to the lying plane $\pi$.

Preferably, the feeding direction L and the lying plane $\pi$ are substantially horizontal.

The two inlet 2 and outlet 3 sections will be suitably aligned along the feeding direction L in order to define a substantially rectilinear feeding direction, so as to not require handing of the item P.

In turn, the support means 4 will be configured for supporting the item P in a position substantially parallel to the lying plane $\pi$, and in particular with its main extension direction X substantially parallel to the advancing direction L.

Therefore, preferably, the item P to be decorated will be arranged in horizontal position.

In the illustrated configuration, the support means 4 will be composed of a longitudinal support member 6, formed by longitudinally offset conveyor belts or rollers, having an upper support surface 7 substantially parallel to the lying plane $\pi$, e.g. horizontal.

Nevertheless, in an alternative, not-illustrated configuration, the support means 4 can be configured for maintaining the items P suspended with respect to the ground in a lying plane $\pi$, still horizontal.

The forwarding means 5 can comprise a plurality of driving roller apparatuses 8, 8', 8''', . . . configured to come into contact with at least one portion S', S'', S''', . . . of the side surface S of the elongate item P in order promote the continuous advancing thereof on the support surface 7.

The plant 1 also comprises decorating means 9 for the external surface S of the elongate item P designed to distribute at least one layer of a pigmented substance on the surface.

According to a particular characteristic of the invention, the decorating means 9 comprise a plurality of jet devices 10, 10', . . . for the application of one or more pigmenting substance layers.

Such devices 10, 10', . . . will be successively arranged along the longitudinal feeding direction L and each of these will be oriented to send a respective jet J of pigmented substance on a respective portion S', S'', . . . of the external surface S of the elongate item P at least partially different from that intended to be decorated by a subsequent device 10, 10', 10'', 10''' present along the feeding direction L.

In this manner, at the outlet section 3, the external side surface S of the elongate item P will be decorated on at least two different portions S', S'', which can be adjacent and possibly slightly overlapped, or offset and possibly mutually opposite with respect to a center plane $\pi'$ passing through the axis A, or with one of such portions overlapped but with different shape than another surface portion.

Each jet device 10, 10', . . . can deposit a layer of a respective pigmented substance of type and/or color not necessarily identical to that deposited by one or more of the other arranged devices 10, 10', . . . .

In addition, the applied layers can be uniform, to define a continuous surface coloring, or configured for applying a predetermined decorative motif.

In particular, the final decorative motif can be given by the union of the different applied layers, which can also have different color tones.

According to a particularly advantageous configuration of the invention, the decorating means 9 will comprise at least one pair of jet devices 10, 10' arranged mutually opposite with respect to a predetermined longitudinal plane parallel to the longitudinal advancing direction L.

For example, the devices 10, 10' of the pair can be arranged mutually opposite with respect to the horizontal lying plane π, as illustrated in FIG. 3, or mutually opposite with respect to a longitudinal center plane π", substantially orthogonal to the lying plane π, as in FIG. 4.

In this manner, it will be possible to decorate different portions S', S", S'", $S^{iv}$ of the side surface S of the elongate item P.

Preferably, the decorating means 9 will comprise both the first pair of application jet devices 10, 10', arranged on mutually opposite with respect to the lying plane π, and the second pair of devices 10", 10'" arranged mutually opposite with respect to the center plane π".

Each of such devices 10, 10', 10", 10'" will be oriented to decorate a respective portion S', S", S'", $S^{iv}$ of the side surface S that is different from that intended to be decorated by the other devices 10, 10', 10", 10'", so as to allow the decoration of the entire side surface S of the elongated object P.

The portions S', S", S'", $S^{iv}$ of the side surface S decorated by each device 10, 10', 10", 10'" can be partly overlapped, i.e. they can be formed by multiple zones alternating with zones of other portions in order to define complex decorative motifs.

Below, for the sake of simplicity and where it is not otherwise specified, reference will be made to a single jet device 10, it being understood that all the parts and functionalities indicated for this device are also found in a substantially analogous and functionally equivalent manner in the other devices 10', 10", 10'".

Preferably, each jet device 10 will comprise one or more distribution nozzles 11 having an inlet 12 connectable to a reservoir 13 of a respective pigmented substance, possibly shared by multiple devices 10, and an outlet 14 adapted to direct a jet J of pigmented substance towards the corresponding portion S', S", S'", $S^{iv}$ of the external surface S of the elongate item P.

In addition, the decorating means 9 will comprise movement means, not illustrated since they are of known type, configured for moving at least one of the nozzles 11, preferably all, along at least one respective first transverse direction Y, Y', Y", Y'" substantially orthogonal to the longitudinal advancing direction L, both in moving closer to and in moving away from the item P.

In this manner, the movement means will position the outlet 14 of the nozzles 11 at a respective predetermined minimum transverse distance d, d', d", d'" from the external surface S of the item P.

The transverse distance d from the external surface S of the elongate item P can be the same for all the nozzles 11 or it can vary between two or more nozzles 11 according to the configuration of the elongate item P to be decorated and the type of pigmented substance to be distributed.

In addition, the movement means of the nozzles 11 can comprise control means, not illustrated in the figures, adapted to maintain the transverse distance d from the external surface S of the item P substantially constant.

Such control means can comprise electric and/or electronic devices for continuously detecting the distance d, which can periodically detect the distance present between the outlet 14 of the nozzles 11 and the surface S of the item P to be decorated.

In particular, the control means can comprise a computerized processing unit associated with one or more position sensors that detect the distance between the nozzle 11 and the surface portion S to be decorated in order to drive the movement means.

In this manner, the variations of distance d between the outlet 14 of the nozzle 11 and the surface S caused by the possible irregularities in the section of the latter can be readily detected by the sensors, so as to maintain such distance d always substantially fixed at a predetermined value.

This characteristic will be particularly advantageous, since it will allow distributing a uniform pigmented layer even in the presence of surfaces S to be decorated having irregular cross section; even possible undercuts can be reached.

According to a particularly advantageous configuration of the invention, the movement means will be configured for moving the nozzles 11 along at least two mutually orthogonal transverse directions.

Due to this particular configuration, the nozzles 11 can be moved along a single transverse direction Y in order to complete a substantially rectilinear motion, or be moved simultaneously along the two transverse directions in order to obtain a compound motion on a plane substantially parallel to the direction of the lying plane π of the elongate item P.

In this manner, even if the distance d is maintained constant, it will be possible to deposit the pigmenting substance on a predetermined region of the side surface S in order to obtain the desired decorative effect.

In a known manner, the movement means can comprise, for each of the nozzles 11, one or more motorized support arms (not illustrated), movable along the two movement directions, or along more than two directions, e.g. three directions in order to allow the spatial movement of the relative nozzle 11.

The electronic control unit can be of CNC type in order to allow the interpolation of the movements of the support arm along two or more movement directions.

In this manner, the nozzles 11 can also be moved in a plane parallel to the feeding direction L in order to follow the item P in its path.

In addition, the plant 1 can comprise at least one heating station 15 placed immediately downstream of one of the application devices 10 in order to facilitate the at least partial polymerization or drying of the pigmenting substance deposited on a corresponding portion of the side surface S of the item P and consolidate its adherence thereto.

For example, the heating station 15 can be placed immediately downstream of the final application device $\mathbf{10}^{iv}$ present along the advancing direction L, in a manner so as to obtain an at least partial drying, polymerization or in any case hardening of the pigmented substance layers, sufficient to allow their immediate handling by an operator or by a collection device.

Advantageously, as an alternative or in addition to the preceding heating station 15, the plant can comprise one or more heating stations 15', 15", 15", $\mathbf{15}^{iv}$ interposed between spray application devices 10 arranged in successive positions along the longitudinal advancing direction L.

Still more preferably, as illustrated in the figures, the plant will comprise a heating station 15', 15", 15", 15$^{iv}$ immediately downstream of each jet device 10.

In addition, a further heating station can also be provided (not illustrated), placed upstream of the first device 10, e.g. at the inlet section 2, in order to proceed with the drying of a possible bottom layer applied in a pre-painting station upstream of the inlet section, not illustrated since this is of known type.

Such pre-painting section can be configured as a function of the characteristics of the material forming the object to be decorated and/or as a function of the type of pigmented substance.

The application of a bottom layer will be particularly necessary if the pigmented substance is a sublimable ink, so as to supply the same with a support for its stable adhesion to the external surface of the object.

The heating stations, indicated for the sake of simplicity with the sole reference 15 (without prime symbols) and schematized in the figures, can comprise an oven 16, e.g. of UV type, such as ovens with mercury or gallium lamps or the like, if the pigmenting substance is a UV ink.

The oven 16 will have a substantially tubular irradiation station 17 with substantially longitudinal axis and axial ends 18, 19 open or openable for the inlet and outlet of the elongated object P.

Inside the irradiation chamber 17, suitable walls can be arranged made of pliable material, oriented in a manner so as to come into contact with a portion of the peripheral surface S of the item P not covered with the decoration from the jet device 10 immediately upstream of the specific oven 16, so as to preserve the integrity of the decorative layer just deposited and not yet sufficiently dried.

The irradiation chamber 17 will have transverse dimensions such to allow the passage of the elongate item P without the side surface portions S just decorated coming into contact with the internal walls of the oven 16 or without them being too close to the heat sources.

In addition, according to other embodiments of the plant not represented in the figures, the oven 16 or analogous heating device can have non-UV ray heat sources, such as heating elements, gas or other fuels, or radiofrequency waves.

The selection of the heat sources used in the heating device will depend on technical factors such as the maximum temperature required inside the chamber 17, the maximum temperature supportable by the material of the elongate item P or by the pigmenting substances.

The man skilled in the art will be able to measure these parameters as a function of the materials constituting the item P and as a function of the pigmenting substances employed.

In addition, in a plant 1 with multiple heating stations 15 it will be possible to provide different temperatures inside the respective ovens 16, in order to allow the optimal drying of different pigmented substances.

Finally, in a preferred configuration, the advancing means 5 can be configured in an analogous manner to the advancing means described for the plant that is the object of the EP1867398 application.

In particular, upstream of each jet device 10, respective driving apparatuses 8 can be provided, formed by a plurality of rollers (indicated overall with 20), configured for being brought into contact with at least one portion of the side surface S of the elongate item P in order to facilitate the continuous advancement thereof along the longitudinal direction L.

From that described above, it is clear that the plant and the method according to the invention attain the pre-established objects and particularly that of providing a plant for the surface decoration of elongated objects that also allows decorating the entire extension of surfaces with complex shape in a quick manner.

The plant and the method according to the invention are susceptible to numerous modifications and variations, all falling within the inventive concept expressed in the enclosed claims. All details can be substituted with technically equivalent elements, and the materials can be different according to needs, without departing from the scope of the invention.

Even if the plant was described with particular reference to the enclosed figures, the reference numbers used in the description and in the claims are employed for improving the comprehension of the invention and do not constitute any limitation of the claimed protective scope.

The invention claimed is:

1. A plant for surface decoration of elongate objects (P), comprising:

an inlet section (2) and an outlet section (3) for one or more substantially elongate items (P) having an external surface (S) to be decorated;

a support system (4) that supports the elongate items (P) on a predetermined lying plane (π);

a forwarding system (5) that continuously forwards the items (P) from said inlet section (2) to said outlet section (3) along a longitudinal feeding direction (L) with said items (P) substantially parallel to said longitudinal direction; and a decorating system (9) that decorates the external surface (S) of the elongate items (P) designed for distributing thereon at least one layer of a pigmented substance, wherein said decorating system (9) comprises a plurality of jet devices (10, 10', . . . ) arranged at different spraying stations along said longitudinal direction (L), at least one of said jet devices (10, 10', . . . ) being oriented to direct a jet (J) of said pigmented substance only on a portion (S') of a same side of the external surface (S) of the items (P) that is at least partially different from another portion (S") of the same side of the external surface (S) to be decorated by another device (10, 10', . . . ) of said plurality, wherein at least one pair of said jet devices (10, 10') comprises said jet devices in mutually opposite positions with respect to a longitudinal plane substantially parallel to said longitudinal feeding direction (L), wherein said decorating system (9) further comprises a moving system that moves said at least one of pair of said jet devices along at least one first transverse direction (Y, Y', . . . ) substantially orthogonal to said longitudinal direction (L) for positioning said jet devices at a predetermined transverse distance (d, d', . . . ) from the external surface (S) of each item (P), wherein said moving system comprises a control system designed to keep said transverse distance (d, d') substantially constant, thereby distributing a uniform pigmented layer even in presence of surfaces to be decorated that have an irregular cross section, wherein said decorating system (9) comprises a first pair of said jet devices (10, 10', . . . ) that are mutually opposite with respect to said laying plane (π) and a second pair of said jet devices (10", 10'" . . . ) that are mutually opposite with respect to a longitudinal center plane (π') substantially orthogonal to said laying plane (π), wherein said different spraying stations are longitudinally offset relative to each other, and wherein a heating station (15) is placed immediately downstream of each of said longitudinally offset jet spraying stations to provide for at least partial polymerization of the pigmented substance deposited on a corresponding portion (S') of the external surface (S) of the items (P) and consolidate adherence thereto of the pigmented substance.

2. The plant as claimed in claim 1, wherein said decorating system (9) comprises a first pair of said jet devices (10, 10', . . . ) mutually opposite with respect to said lying plane (π) and a second pair of said jet devices (10", 10'", . . . ) mutually opposite with respect to a longitudinal center plane (π') substantially orthogonal to said lying plane (π).

3. The plant as claimed in claim 1, wherein each of said jet devices (10, 10', . . . ) comprises at least one distribution nozzle (11) having an inlet (12) connectable to a reservoir (13) of said pigmented substance and an outlet (14) designed to direct the jet (J) of said substance towards a corresponding portion (S', S", . . . ) of the external surface (S) of the items (P) to be decorated.

4. The plant as claimed in claim 1, wherein said moving system is designed to move said jet devices (10, 10', . . . ) at least along two mutually orthogonal transverse directions.

5. The plant as claimed in claim 1, further comprising at least one heating station (15) placed immediately downstream of one of said jet devices (10, 10', . . . ).

6. The plant as claimed in claim 1, further comprising at least one heating station (15) interposed between two successive jet devices (10, 10') along said longitudinal feeding direction (L).

7. The plant as claimed in claim 1, further comprising at least one heating station (15) which comprises an oven (16) having a substantially tubular irradiation chamber (17) with a substantially longitudinal axis and end openings (18, 19) for the inlet and outlet of the elongate items (P).

8. The plant as claimed in claim 1, wherein said support system (6) comprises a substantially horizontal longitudinal support surface (7) defining said lying plane (π), said forwarding system (5) comprising a plurality of driving rollers (20) configured to come into contact with at least one portion of the external surface (S) of the elongate items (P) in order to promote a continuous forwarding thereof on said horizontal longitudinal support surface (7).

9. The plant as claimed in claim 1, further comprising a computerized processing unit operatively coupled to one or more position sensors that continuously detect said distance (d, d') to drive said moving system.

* * * * *